US007201152B2

(12) United States Patent
Leymarie et al.

(10) Patent No.: US 7,201,152 B2
(45) Date of Patent: Apr. 10, 2007

(54) CONNECTOR FOR IN-TANK FUEL DELIVERY ASSEMBLY

(75) Inventors: Pascal Leymarie, Châlons en Champagne (FR); Robert Renaud, Châlons en Champagne (FR)

(73) Assignee: TI Automotive Fuel Systems SAS, Chalons en Champagne (FR)

( * ) Notice: Subject to any disclaimer, the term of this patent is extended or adjusted under 35 U.S.C. 154(b) by 0 days.

(21) Appl. No.: 11/230,831

(22) Filed: Sep. 20, 2005

(65) Prior Publication Data

US 2006/0065248 A1 Mar. 30, 2006

(30) Foreign Application Priority Data

Sep. 28, 2004 (FR) ..... 04 10244

(51) Int. Cl.
*F02M 37/04* (2006.01)
*F02B 67/00* (2006.01)

(52) U.S. Cl. ..... 123/509; 123/195 A

(58) Field of Classification Search ..... 123/509, 123/195 A

See application file for complete search history.

(56) References Cited

U.S. PATENT DOCUMENTS 4,768,925 A * 9/1988 Geupel ..... 415/213.1
4,807,582 A 2/1989 Tuckey
4,964,787 A * 10/1990 Hoover ..... 417/363
5,758,627 A * 6/1998 Minagawa et al. ..... 123/509
6,293,770 B1 * 9/2001 Matsumoto et al. ..... 417/361
6,302,144 B1 10/2001 Graham et al.
6,308,733 B2 * 10/2001 Murakoshi et al. .... 137/565.34
6,378,504 B1 * 4/2002 Horiuchi et al. ..... 123/509
6,401,751 B2 * 6/2002 Murakoshi et al. .... 137/565.34
6,513,503 B2 * 2/2003 Iwamoto et al. ..... 123/509
6,517,327 B2 * 2/2003 Beyer et al. ..... 417/363
6,619,271 B2 * 9/2003 Iwamoto et al. ..... 123/509
6,773,241 B2 * 8/2004 Suzuki et al. ..... 417/423.3
6,904,928 B2 * 6/2005 Powell et al. ..... 137/202
6,923,164 B1 * 8/2005 Mitsudou et al. ..... 123/509
6,966,330 B2 * 11/2005 Frohwein ..... 137/202
7,025,574 B2 * 4/2006 Cremer et al. ..... 417/363
2002/0112700 A1 * 8/2002 Iwamoto et al. ..... 123/509
2006/0065247 A1 * 3/2006 Leymarie et al. ..... 123/509

FOREIGN PATENT DOCUMENTS

FR 2771972 6/1999
WO WO 0225094 3/2005

* cited by examiner

*Primary Examiner*—Hai Huynh
(74) *Attorney, Agent, or Firm*—Reising, Ethington, Barnes, Kisselle, P.C.

(57) ABSTRACT

A connector attaches an accessory to a fuel pump module. The connector includes a fuel pump module mounting member having attachment features to attach the mounting member to the fuel pump module, and movement limiting features to resist relative movement with respect to the fuel pump module. The connector also includes an accessory mounting extension that extends from the mounting member and includes attachment features to attach the accessory to the connector.

20 Claims, 3 Drawing Sheets

CONNECTOR FOR IN-TANK FUEL DELIVERY ASSEMBLY

CROSS-REFERENCES TO RELATED APPLICATIONS

Applicants claim priority of French Patent Application, Ser. No. 0410244, filed Sep. 28, 2004; and the present invention is related to pending U.S. patent application of Pascal Leymarie et al., Ser. No. 11/230,401, filed Sep. 20, 2005, entitled "IN-TANK FUEL DELIVERY ASSEMBLY WITH A PIVOTALLY MOUNTED EMISSIONS CANISTER", assigned to the assignee hereof and incorporated herein by reference.

FIELD OF THE INVENTION

This invention relates generally to fuel delivery systems for vehicles and, more particularly, to a fuel delivery assembly disposed in a fuel tank and including an accessory such as an emissions canister.

BACKGROUND OF THE INVENTION

For quite some time, fuel delivery systems for vehicles have typically included a fuel delivery assembly mounted within and received through an access opening in an upper wall of a fuel tank of a vehicle. A typical fuel delivery assembly may include a fuel pump module for delivering fuel from the fuel tank to a vehicle engine, a mounting flange for mounting to the upper wall of the fuel tank within the access opening, and a reservoir housing connected to the mounting flange. The reservoir housing may be of generally cylindrical shape, under normal operating conditions, contains a predetermined volume of fuel therein regardless of normal changes in inclination of the vehicle, and houses an electric fuel pump therein with an intake port and filter in communication with the interior of the reservoir housing. The fuel pump module is mounted to and within the fuel tank so that the bottom of the reservoir housing rests on the bottom of the fuel tank either directly or via supporting feet. The mounting flange may include various conduits that extend from the vehicle engine, through the mounting flange, and terminate in connections to various components of the fuel delivery assembly. The fuel pump module may also include a fuel level sender mounted to the reservoir housing and having a float and variable resistor to sense the level of fuel in the fuel tank.

More recently, fuel delivery assemblies may also include various accessories, such as a filter, a fuel additive cartridge, or a carbon canister for reducing evaporative emissions from the fuel tank. The carbon canister functions to limit emissions of fuel vapors from the fuel tank into the atmosphere. The carbon canister includes a housing containing activated carbon therein to trap fuel vapors therein and store the fuel vapors for subsequent release and combustion in the engine. The carbon canister includes conduits, which are connected between the canister housing to nipples on the mounting flange. Carbon canisters are of generally cylindrical shape and may be relatively loosely placed within the fuel tank and connected to the reservoir housing by flexible and twistable plastic brackets.

Unfortunately, however, when the vehicle is in motion, sometimes the loosely mounted carbon canister may move and interfere with other components.

SUMMARY OF THE INVENTION

A connector attaches an accessory, such as a carbon canister, to a fuel pump module within a fuel tank of a vehicle. The connector includes a fuel pump module mounting member with attachment features to attach the mounting member to the fuel pump module, and movement limiting features to resist relative movement with respect to the fuel pump module. The connector also includes an accessory mounting extension that extends from the mounting member and includes attachment features to attach the accessory to the connector.

According to preferred aspects of the connector, the connector is ring shaped and configured to surround a reservoir tank of the fuel pump module, and the connector is snap-fit fastened to the reservoir tank and to the accessory. Also preferably, the connector includes movement limiting features to resist axial and rotational movement of the connector relative to the fuel pump module.

At least some of the objects, features and advantages that may be achieved by at least certain embodiments of the invention include providing a device to enable accessories such as carbon canisters to be fastened within a fuel tank; positioning an accessory in relation to a fuel pump module to simplify conduit connections between them; providing a connector that immobilizes an accessory inside a fuel tank of a vehicle to avoid any unwanted movement of the accessory when the vehicle is in motion; prevents the accessory from interfering with other components; provides a common or modular connector to enable attachment of various types of accessories to a common type of fuel pump module; is of relatively simple design and economical manufacture and assembly, rugged, durable, reliable and in service has a long useful life.

Of course, other objects, features and advantages will be apparent in view of this disclosure to those skilled in the art. Various other connectors embodying the invention may achieve more or less than the noted objects, features or advantages.

BRIEF DESCRIPTION OF THE DRAWINGS

These and other objects, features and advantages of the present invention will be apparent from the following detailed description of the preferred embodiment and best mode, appended claims, and accompanying drawings in which:

DETAILED DESCRIPTION OF THE PREFERRED EMBODIMENTS

Figure 1:
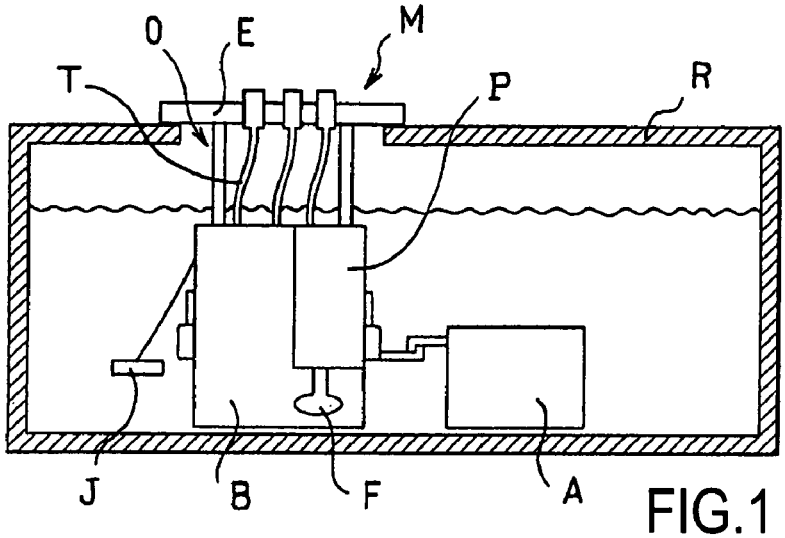
FIG. 1 is a side view of a fuel delivery assembly mounted inside a fuel tank shown in cross section.

Referring in more detail to the drawings, FIG. 1 illustrates a fuel delivery assembly mounted within and received through an access opening O in an upper wall of a vehicle fuel tank R. The fuel delivery assembly preferably includes a fuel pump module M for delivering fuel from the fuel tank R to a vehicle engine, and an accessory A connected to the fuel pump module M.

The fuel pump module M includes a mounting flange E for mounting to a lip of the upper wall of the fuel tank R within the access opening O, and a reservoir housing B connected to the mounting flange E in any suitable manner. The fuel pump module M is mounted via the mounting flange E to the top wall of the fuel tank R, and extends downwardly into the fuel tank R so that the bottom of the reservoir housing B preferably rests on the bottom of the fuel tank R either directly or via supporting feet. Accordingly, in assembly, the fuel pump module M constitutes an anchored device within the fuel tank R and to which the accessory A may be connected. As shown, various conduits T may extend through the mounting flange E, and terminate in connections to various components of the fuel delivery assembly.

The reservoir housing B may be of generally cylindrical shape, preferably in normal operation contains a predetermined volume of fuel therein regardless of normal changes in inclination of the vehicle, and houses an electric fuel pump P therein with an intake port and filter F in communication with the interior of the reservoir housing B. The fuel pump module M may also include a fuel level sender mounted to the reservoir housing B and having a float J and variable resistor (not shown) to sense the level of fuel in the fuel tank R.

The accessory A may be any suitable accessory such as a filter, a fuel additive cartridge, or preferably a carbon canister for reducing evaporative emissions from the fuel tank R. The carbon canister functions to limit emissions of fuel vapors from the fuel tank R into the atmosphere. The carbon canister includes a housing of generally cylindrical shape containing activated carbon therein to trap fuel vapors therein and store the fuel vapors for subsequent release and combustion in the engine. The carbon canister may also include conduits, which are connected between the canister housing to nipples on the mounting flange E.

Figure 2:
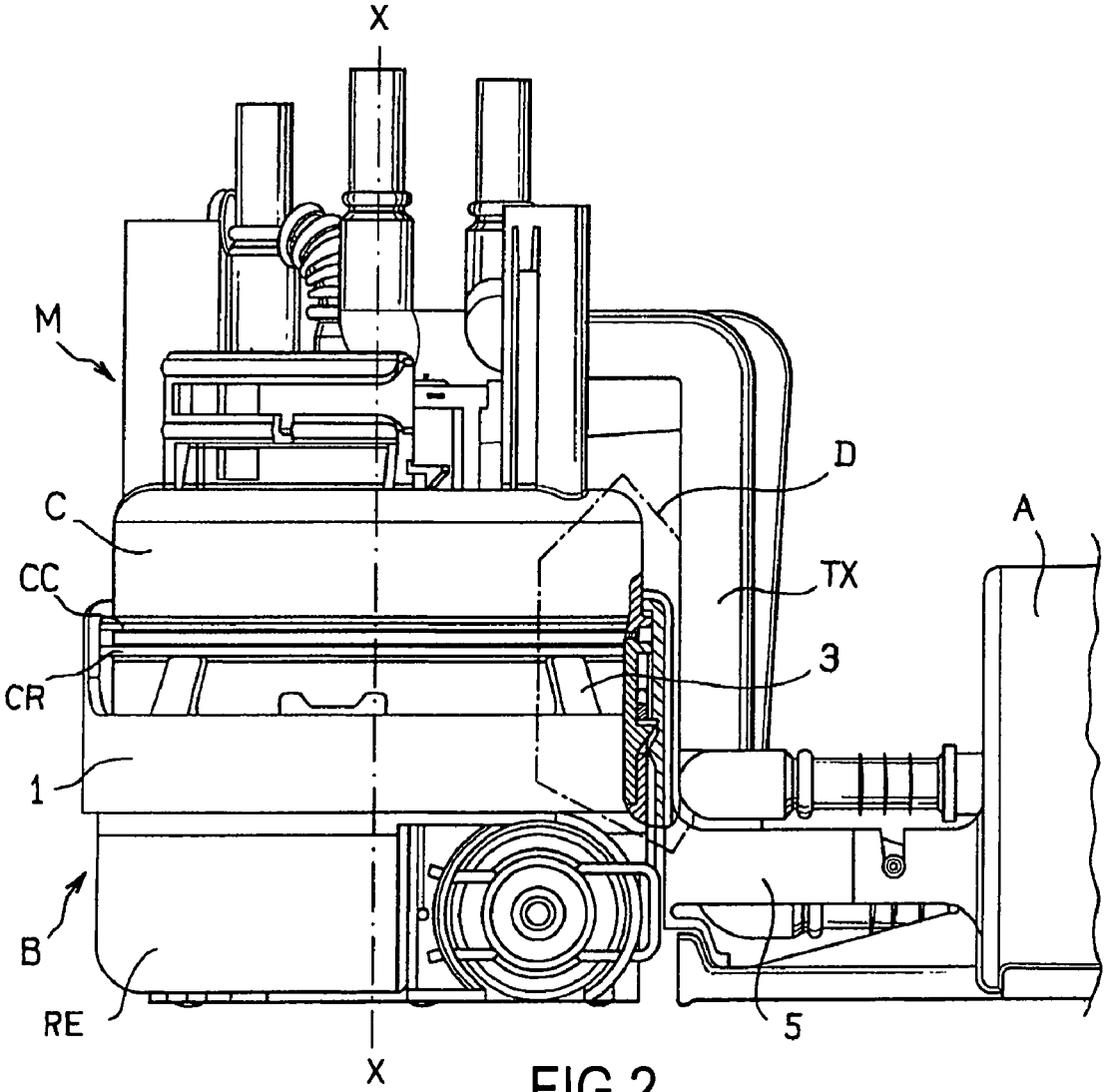
FIG. 2 is a partially-sectioned side view of a fuel delivery assembly including a connector connecting a fuel pump module to an accessory.

FIG. 2 illustrates the manner in which the accessory A is preferably attached to the fuel pump module M. As shown, a connector including a fuel pump module mounting member or ring 1 is used to attach the accessory A to the reservoir tank B of the fuel pump module M. The positioning of the accessory A in relation to the fuel pump module M facilitates the mounting of conduits TX, which are used for fluid communication between the accessory A to the fuel pump module M.

The reservoir tank B is an assembly composed of a receptacle RE, topped with a lid C. The reservoir tank B is of a generally cylindrical shape with a longitudinal central axis X—X. The receptacle RE and the lid C are attached, and preferably welded, to each other after the fuel pump is installed therein. A radially outwardly extending annular collar CR borders a circular top opening of the receptacle RE, and a collar CC of similar shape borders the lid C. The weld joint between the receptacle RE and the lid C is preferably between the collars CR and CC.

Figure 5:
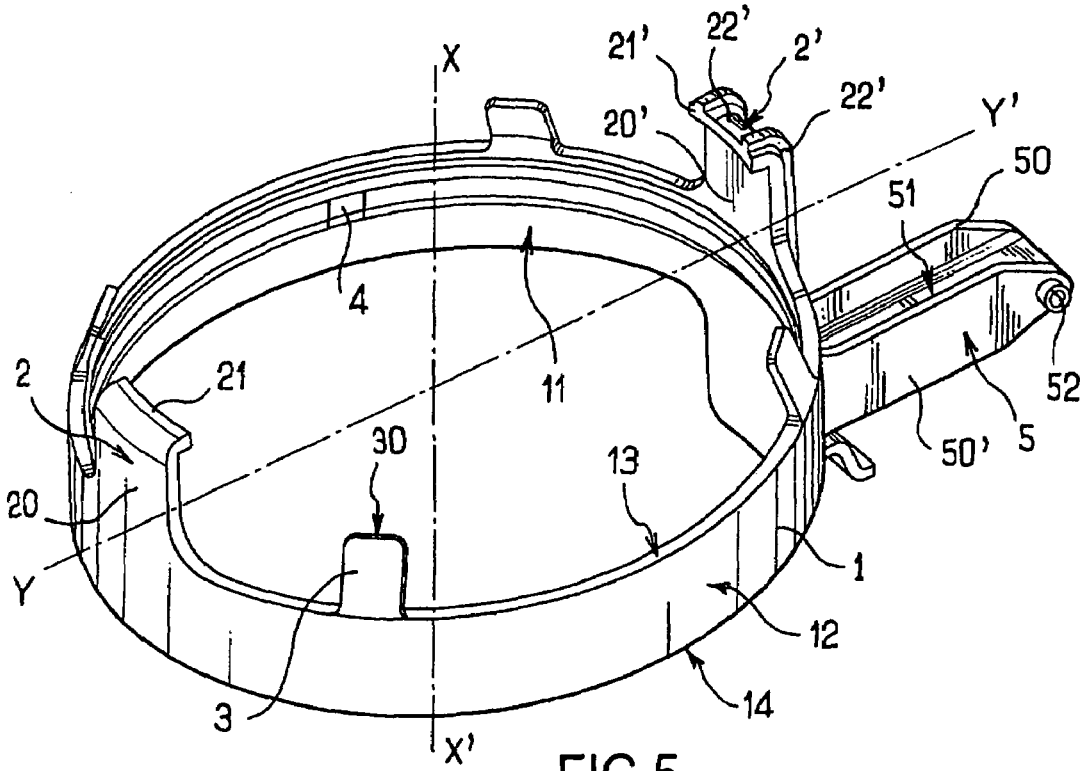
FIG. 5 is a perspective view of the connector.
Figure 6:
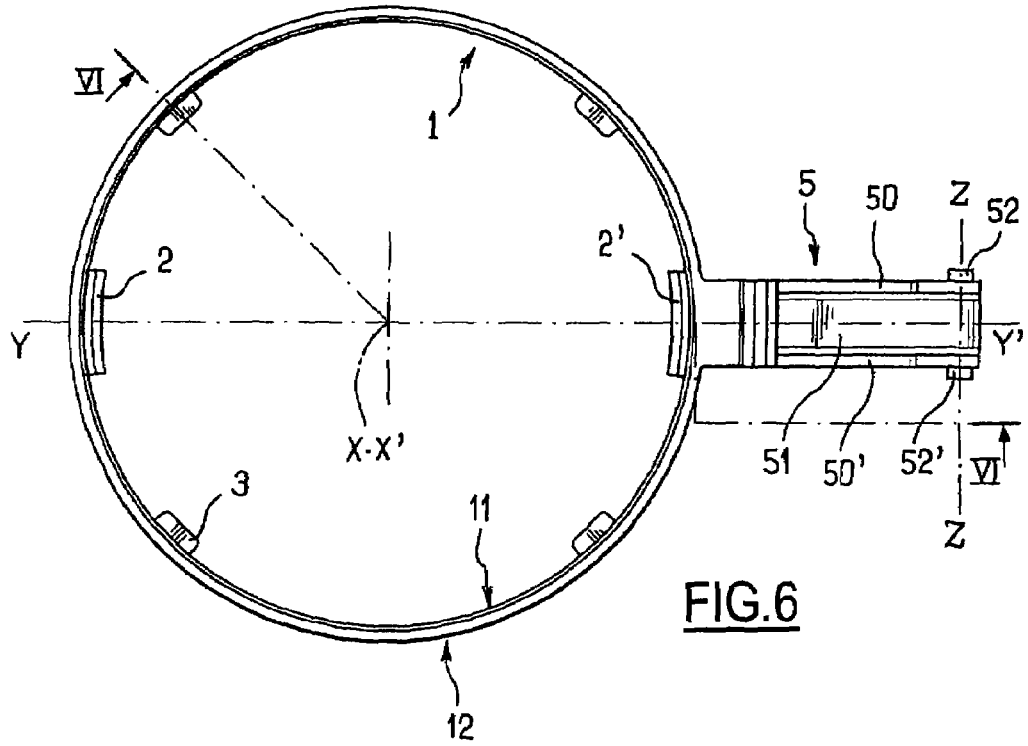
FIG. 6 is a plan view of the connector of FIG. 5.
Figure 7:
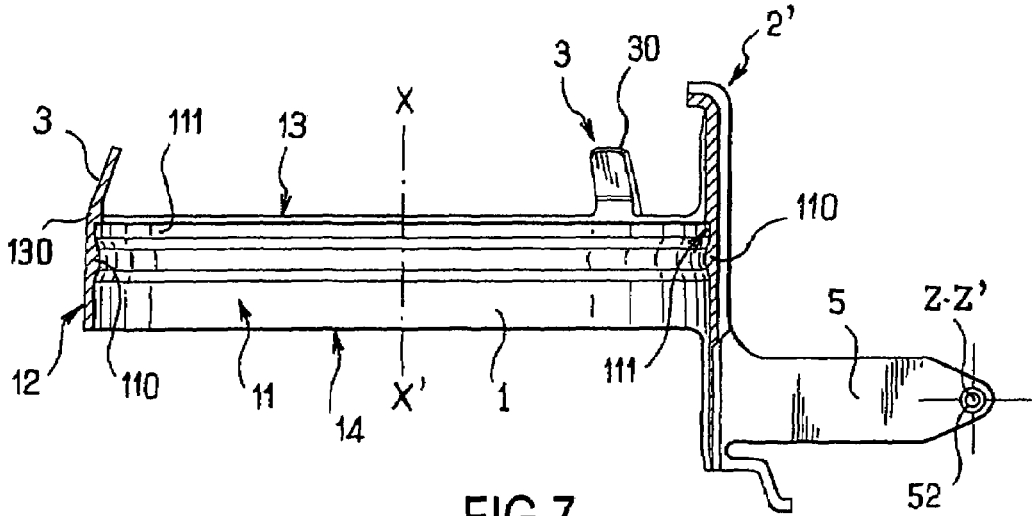
FIG. 7 is a cross-sectional view of the connector of FIG. 6, taken along line VI—VI thereof.

Referring now to FIGS. 5 through 7, the connector is preferably composed of plastic, includes the support or mounting ring 1 having a generally annular shape configured for attachment around the reservoir tank B, and further includes an attachment bracket or mounting extension 5, which is preferably integrally formed with the ring 1 and configured for pivotable attachment to a portion of the accessory A. The ring 1 is basically an annular wall having an internal surface 11 and an external surface 12, and is of relatively low or short height between an upper edge 13 and a lower edge 14 thereof. The internal diameter of the ring 1 is preferably just slightly greater than that of the reservoir tank B as measured at the collars CR and CC. The ring 1 has a longitudinal axis X–X', which is preferably coaxial with the axis X—X of the reservoir tank B when the ring 1 is mounted on the reservoir tank B.

As best shown in FIG. 7, the internal surface 11 of the ring 1 includes an annular rib 110 that projects radially inward of the surface 11 of the ring 1. The upper edge 13 of the ring 1 is bordered by a collar 130 that extends radially inwardly into the interior of the ring 1. The ring 1 also includes an annular groove 111 defined between the collar 130 and the rib 110. The rib 110 and the groove 111 enable attachment of the ring 1 to the reservoir tank B. As best shown in the sectioned portion of FIG. 4, the reservoir tank B includes a series of lugs or an annular projection S formed on the external wall thereof that fits within the groove 111, so as to attach the ring 1 around the reservoir tank B by a detent or snap-fit effect.

As shown in FIG. 5, the ring 1 is preferably provided with features to prevent or resist axial movement with respect to the reservoir housing B. More specifically, the ring 1 is preferably integrally molded with several positioning brackets 2, 2' and tabs 3, respectively two and four in number, which extend from the upper edge 13 of the ring 1. It will be appreciated by one of ordinary skill in the art, however, that the number of brackets 2, 2' or of tabs 3 can vary without moving outside the scope of the invention. The brackets 2, 2' and tabs 3 fit onto the reservoir tank B, in order to ensure axial and angular positioning of the ring 1 with respect thereto, and to prevent or resist unwanted movement between the ring 1 and the reservoir tank B. The brackets 2, 2' are diametrically opposed and preferably aligned with the mounting extension 5 along line Y–Y', which is in a vertical plane that symmetrically divides the connector. Each bracket 2, 2' preferably includes a vertical portion 20, 20' extending upwards from the upper edge 13 of the ring 1 and parallel to the axis X–X', and wings 21, 21' terminating the vertical portions 20, 20' and extending radially inwardly toward the interior of this ring 1.

Figure 4:
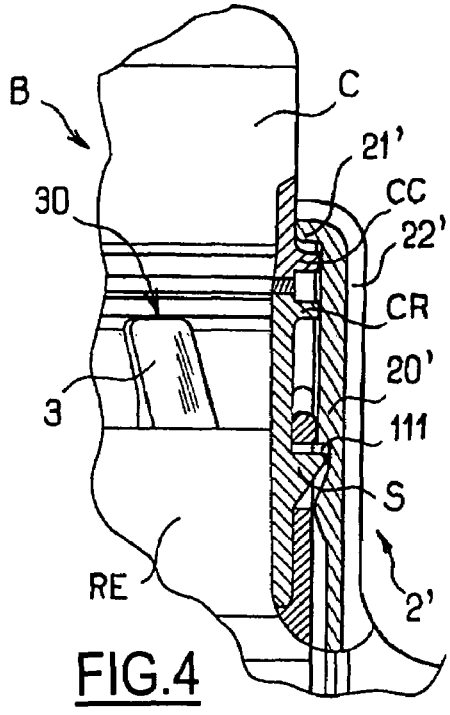
FIG. 4 is an enlarged partially-sectioned side view of a portion D of the fuel delivery assembly of FIG. 2, showing the connector attached to the fuel pump module.

As shown in FIG. 4, when the ring 1 is in place, it is mounted around the reservoir tank B, so that the wings 21, 21' rest against the collar CC of the reservoir tank lid C. The positioning brackets 2, 2' therefore vertically maintain the ring 1 with respect to the reservoir tank B and, thus, prevent or resist the ring 1 from shifting down around the reservoir tank B. The brackets 2, 2' also include two parallel stiffening ribs 22' on the outer surfaces of the brackets 2, 2' to provide strength to handle stress created by the weight of the accessory A.

Referring to FIGS. 6 and 7, the tabs 3 are separated uniformly at 90° from each other and at 45° in relation to the brackets 2 or 2'. As best shown in FIG. 7, the tabs 3 extend from the upper edge 13 of the ring 1 and angle slightly upward and radially inward. The tabs 3 do not extend as high as the brackets 2, 2', so that when the ring 1 snaps onto the reservoir tank B as best shown in FIG. 4, the upper end 30 of the tabs 3 abuts against the collar CR of the receptacle RE to prevent or resist the ring 1 from rising axially to the top of the reservoir tank B. Additionally, the tabs 3 are yieldable or elastically deformable such that as the ring slides into position over the reservoir tank B, the tabs 3 temporarily move or deflect radially outwardly from the center of the ring 1 while passing over the collars CC and CR, and subsequently return to their original position once the ring 1 snaps into place on the reservoir tank B.

Referring now to FIG. 5, the ring 1 is also provided with features to prevent or resist rotational movement of the ring 1 relative to the reservoir housing B. More specifically, the ring 1 preferably has notches 4 to prevent or resist the ring 1 from rotating around the reservoir tank B about longitudinal axis X—X. The notches 4 are preferably located in the annular rib 110 and are configured to receive in assembly a lug (not shown) provided on the outer surface of the receptacle RE of the reservoir housing B.

Referring to FIGS. 5 through 7, the mounting extension 5 projects radially outward from the external surface 12 of the ring 1, and enables attachment of the accessory A to the connector, and also constitutes a pivoting element of a hinge. The mounting extension 5 is symmetrical and includes two sides 50, 50' that extend from the ring 1 along line Y–Y'. The sides 50, 50' are connected together by a horizontal wing or web 51 so that in transverse cross section the mounting extension 5 has an "H" shape. At a free end of the mounting extension 5, two lugs 52, 52' project perpendicularly from the respective outer surfaces of the two sides 50, 50'. The two pins or lugs 52, 52' define a pivot axis Z–Z' of the accessory A about the hinge, which is preferably substantially perpendicular to aforementioned axis X–X' and axis Y–Y' shown in FIG. 5.

Figure 3:
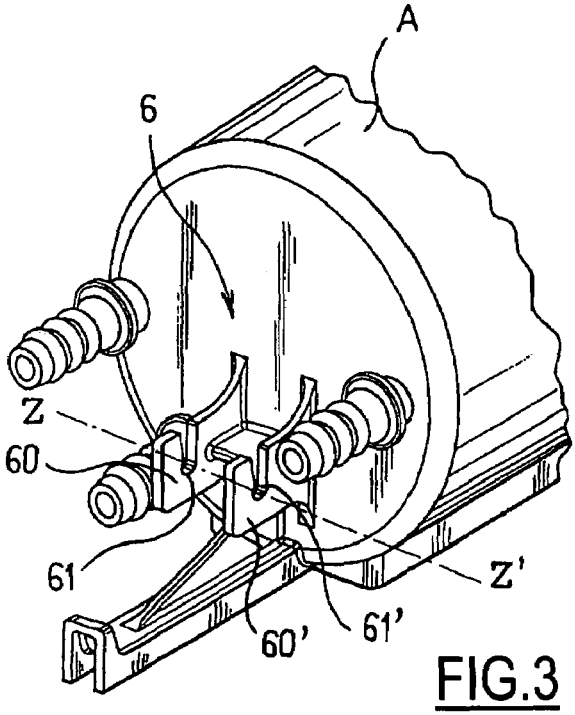
FIG. 3 is a partial perspective view of the accessory of FIG. 2.

As shown in FIG. 3, the accessory A is preferably a carbon canister including active carbon therein, wherein the accessory A supports another pivoting element 6 of the hinge. The pivoting element 6 includes two parallel plates 60, 60' including notches 61, 61' therein and partially defined by rounded portions. The notches 61, 61' are configured to receive the lugs 52, 52' of the mounting extension 5 of the connector in a snap-fit or detent manner.

The accessory A is accurately positioned in relation to the fuel pump module M by the hinge members defined by the plates 60, 60' of the accessory A and the mounting extension 5 of the connector. Accordingly, the accessory A is not only attached to the fuel pump module M, but is also preferably hinged in relation to the fuel pump module M. The hinge provides a certain degree of freedom between accessory A and the fuel pump module M that can be advantageous during introduction of the assembly into the fuel storage tank R and facilitates connection of the conduits TX extending between the accessory A and the fuel pump module M.

According to other implementations not shown in the drawings, the mounting extension 5 could be simply snap-fit connected to the accessory A instead of also being hinged. Likewise, it would also be possible to lengthen the brackets 2, 2' so that the wings 21, 21' are positioned above the lid C and not on the collar CC. According to yet another embodiment, the ring 1 could be constructed of two separate parts attached together and clamped around on the reservoir tank B such as by screwing the two parts together.

As used in this specification and claims, the terms "for example," "for instance," and "such as," and the verbs "comprising," "having," "including," and their other verb forms, when used in conjunction with a listing of one or more components or other items, are each to be construed as open-ended, meaning that that the listing is not to be considered as excluding other, additional components, elements, or items. Moreover, directional words such as top, bottom, upper, lower, radial, circumferential, axial, lateral, longitudinal, vertical, horizontal, and the like are employed by way of description and not limitation. Other terms are to be construed using their broadest reasonable meaning unless they are used in a context that requires a different interpretation. When introducing elements of the present invention or the embodiments thereof, the articles "a," "an," "the," and "said" are intended to mean that there are one or more of the elements.

It is to be understood that the invention is not limited to the particular exemplary embodiments disclosed herein, but rather is defined by the following claims. In other words, the statements contained in the foregoing description relate to a particular exemplary embodiment and are not to be construed as limitations on the scope of the invention as claimed or on the definition of terms used in the claims, except where a term or phrase is expressly defined above.

Although the present invention has been disclosed in conjunction with a presently preferred exemplary embodiment, many others are possible and it is not intended herein to mention all of the possible equivalent forms and ramifications of the present invention. Other modifications, variations, forms, ramifications, substitutions, and/or equivalents will become apparent or readily suggest themselves to persons of ordinary skill in the art in view of the foregoing description. In other words, the teachings of the present invention encompass many reasonable substitutions or equivalents of elements recited in the following claims. As just one example, the disclosed structure, materials, sizes, shapes, and the like could be readily modified or substituted with other similar structure, materials, sizes, shapes, and the like. Indeed, the present invention is intended to embrace all such forms, ramifications, modifications, variations, substitutions, and/or equivalents as fall within the spirit and broad scope of the following claims.

What is claimed is:

1. A connector used to connect an accessory to a fuel pump module, comprising:

a fuel pump module mounting member having an internal surface and an external surface, a groove and a rib disposed on the internal surface and configured to attach the mounting member to the fuel pump modules; and an accessory mounting extension extending from the mounting member and outwardly of the fuel pump module and having attachment features to attach the accessory to the connector.

2. The connector of claim 1, wherein the mounting member is ring-shaped.

3. The connector of claim 1, which also comprises at least one bracket extending from the mounting member to resist downward longitudinal movement of the mounting member with respect to the fuel pump module.

4. The connector of claim 3, wherein the at least one bracket includes two opposed brackets each having a vertical portion and a wing terminating the vertical portion and extending radially inwardly.

5. The connector of claim 1, which also comprises at least one tab extending from the mounting member to resist upward longitudinal movement of the connector with respect to the fuel pump module.

6. The connector of claim 5, wherein the at least one tab is elastically deformable.

7. The connector of claim 1, which also comprises at least one notch in the internal surface of the mounting member to resist rotational movement of the mounting member with respect to the fuel pump module.

8. The connector of claim 1, wherein the mounting extension attachment features includes lugs that define a pivot axis.

9. The connector of claim 8, wherein the mounting extension includes sides that extend from the mounting member and are connected by a web such that in transverse cross section the mounting extension has an "H" shape, and further wherein the lugs extend from the sides adjacent a free end of the mounting extension.

10. A connector used to connect an accessory to a fuel pump module, comprising:

a fuel pump module member having an internal surface and an external surface, attachment features having a groove and a rib disposed in the internal surface and configured to attach the mounting member to the fuel pump module by a snap-fit effect, and movement limiting features to resist relative movement with respect to the fuel pump module; and an accessory mounting extension extending from the mounting member and including attachment features to attach the accessory to the connector.

11. A fuel delivery assembly for insertion into a fuel tank of a vehicle, comprising:

a fuel pump module including a reservoir housing having at least one projection;

an accessory;

a connector connecting the accessory to the reservoir housing of the fuel pump module, wherein the connector includes:

a fuel pump module mounting member having an internal surface and an external surface, and a groove and a rib on the internal surface which cooperate with the projection to attach the mounting member to the fuel pump module with a snap-in receipt of the projection in the groove; and an accessory mounting extension extending from the mounting member and outward of the reservoir housing and having attachment features to attach the accessory to the connector.

12. The fuel delivery assembly of claim 11, wherein the mounting member includes an internal surface and an external surface, further wherein the movement limiting features include at least one notch in the internal surface configured to cooperate with the reservoir housing of the fuel pump module to resist rotational movement with respect to the fuel pump module.

13. The fuel delivery assembly of claim 12, wherein the accessory includes a mounting extension including notches therein, further wherein the lugs of the mounting extension of the connector engage the notches of the accessory for connecting the fuel pump module and the accessory together.

14. The fuel delivery assembly of claim 11, wherein the mounting extension includes sides extending from the mounting member and connected by a web such that in transverse cross section the mounting extension has an "H" shape, and also includes lugs that extend from the sides adjacent a free end of the mounting extension.

15. A fuel delivery assembly for insertion into a fuel tank of a vehicle, comprising:

a fuel pump module including a reservoir housing having an annular projection;

an accessory:

a connector connecting the accessory to the reservoir housing of the fuel pomp module, wherein the connector includes:

a fuel pump module mounting member which is ring shaped, has an internal surface and an external surface, a groove and a rib disposed in the internal surface, and the annular projection of the reservoir housing fits within the groove of the mounting member by a snap-fit effect to attach the mounting member to the fuel pump module and movement limiting features to resist relative movement with respect to the fuel pump module; and an accessory mounting extension extending from the mounting member and including attachment features to attach the accessory to the connector.

16. The fuel delivery assembly of claim 15, wherein the movement limiting features of the mounting member includes two opposed brackets extending from the mounting member to resist downward longitudinal movement of the mounting member with respect to the fuel pump module, further wherein the brackets each include a vertical portion and a wing terminating the vertical portion and extending radially inwardly.

17. The fuel delivery assembly of claim 16, wherein the reservoir housing further includes a receptacle covered by a lid wherein the receptacle and lid each include a collar, further wherein the wings of the brackets bear against the collar of the lid.

18. The fuel delivery assembly of claim 17, wherein the movement limiting features include at least one elastically deformable tab extending from the mounting member and configured to bear against the collar of the receptacle of the reservoir housing to resist upward longitudinal movement of the connector with respect to the fuel pump module.

19. A connector for attaching an accessory to a fuel pump module within a fuel tank of a vehicle, comprising:

a fuel pump module mounting ring having an internal surface and an external surface, wherein a groove is disposed in the internal surface and a rib is disposed on the internal surface for snap-fit engagement with the fuel pump module, and further having movement limiting features to resist relative movement with respect to the fuel pump module; and an accessory mounting extension extending from the mounting member and including sides and lugs disposed on the sides for connecting to the accessory.

20. The connector of claim 19, wherein the movement limiting features of the mounting member include at least one bracket extending from the mounting member and including a vertical portion and a wing terminating the vertical portion and extending radially inwardly to resist downward longitudinal movement of the mounting member with respect to the fuel pump module, and the movement limiting features further include at least one elastically deformable tab extending from the mounting member to resist upward longitudinal movement of the connector with respect to the fuel pump module.

* * * * *